US010857414B1

(12) United States Patent
Lopez

(10) Patent No.: US 10,857,414 B1
(45) Date of Patent: Dec. 8, 2020

(54) WEARABLE RESISTANCE EXERCISE GARMENT AND METHOD OF RESISTANCE EXERCISE

(71) Applicant: Tracy L Lopez, Philadelphia, PA (US)

(72) Inventor: Tracy L Lopez, Philadelphia, PA (US)

( * ) Notice: Subject to any disclaimer, the term of this patent is extended or adjusted under 35 U.S.C. 154(b) by 0 days.

(21) Appl. No.: 16/436,156

(22) Filed: Jun. 10, 2019

(51) Int. Cl.

| | |
|---|---|
| ***A63B 21/00*** | (2006.01) |
| ***A41D 1/08*** | (2018.01) |
| ***A41D 27/20*** | (2006.01) |
| ***A63B 21/04*** | (2006.01) |
| ***A63B 21/055*** | (2006.01) |
| ***A63B 23/12*** | (2006.01) |
| ***A41D 13/00*** | (2006.01) |
| ***A41B 11/08*** | (2006.01) |

(52) U.S. Cl.
CPC ..... *A63B 21/4013* (2015.10); *A41B 11/08* (2013.01); *A41D 1/08* (2013.01); *A41D 13/0015* (2013.01); *A41D 27/20* (2013.01); *A63B 21/0442* (2013.01); *A63B 21/0552* (2013.01); *A63B 21/4035* (2015.10); *A63B 23/12* (2013.01); *A41D 2300/32* (2013.01); *A41D 2300/33* (2013.01)

(58) Field of Classification Search
CPC ..... A63B 21/02; A63B 21/04; A63B 21/0442; A63B 21/055–0557; A63B 21/4011–4015; A63B 21/4025; A41D 1/08; A41D 13/0015; A41D 27/20; A41D 2300/32; A41D 2300/33; A41B 11/08
See application file for complete search history.

(56) References Cited

U.S. PATENT DOCUMENTS

| | | | | |
|---|---|---|---|---|
| 5,201,074 A * | 4/1993 | Dicker | A41D 13/0015 2/227 |
| 5,357,637 A | 10/1994 | Moore | |
| 5,700,231 A * | 12/1997 | Wilkinson | A63B 21/00185 482/121 |
| 5,842,959 A * | 12/1998 | Wilkinson | A41D 13/0015 482/121 |
| 5,875,491 A * | 3/1999 | Wilkinson | A41D 13/0015 2/227 |
| 6,047,405 A * | 4/2000 | Wilkinson | A41D 13/0015 2/115 |
| 7,730,552 B2 | 6/2010 | Ota | |
| 2010/0041527 A1 * | 2/2010 | Miller | A63B 21/4015 482/124 |

(Continued)

*Primary Examiner* — Jennifer Robertson
(74) *Attorney, Agent, or Firm* — Vincent G. LoTempio; David T. Stephenson

(57) ABSTRACT

A wearable resistance exercise garment and method of resistance exercise provides stretchy material athletic pants with elastic bands attached at the ankle ends for resistance exercises. The wearer pulls one end of the elastic bands in a first direction to generate an external resistance force that is counterbalanced by the weight and feet of the wearer. The pants have an upper waist section and a pair of legs terminating at two ankle ends. The ankle ends form openings that enable passage of the feet. A hook and loop fastener strap regulates the snugness around the ankle. A fastenable pocket forms at ankle ends. Elastic bands have a first end fixedly attach to the pocket, and a second end that can be grasped by the wearer. The bands are pulled in first direction and manipulated for resistance training. When not in use, the bands are tucked into their respective pockets.

20 Claims, 18 Drawing Sheets

(56) References Cited

U.S. PATENT DOCUMENTS

| | | | | |
|---|---|---|---|---|
| 2011/0209264 | A1* | 9/2011 | Williams | A41D 13/0015 2/69 |
| 2012/0202658 | A1* | 8/2012 | Menefee, Sr. | A63B 21/151 482/124 |
| 2015/0297938 | A1* | 10/2015 | Dyer | A63B 21/4034 2/160 |
| 2015/0305413 | A1* | 10/2015 | DeYoung | A63B 21/4011 2/229 |
| 2016/0317853 | A1* | 11/2016 | Benocci | A63B 21/0557 |
| 2017/0361151 | A1* | 12/2017 | Mottern | A41D 13/0015 |
| 2019/0281902 | A1* | 9/2019 | Nabors | A41D 19/0024 |
| 2020/0085123 | A1* | 3/2020 | Achtymichuk | A41D 13/0015 |

* cited by examiner

WEARABLE RESISTANCE EXERCISE GARMENT AND METHOD OF RESISTANCE EXERCISE

FIELD OF THE INVENTION

The present invention relates generally to a wearable resistance exercise garment and method of resistance exercise. More so, the present invention relates to a wearable athletic garment that provides a pair of resilient pants for exercise that have elastic band extending from the ankle that a wearer can grasp at the free ends to pull the elastic bands in a first direction for exercising the upper body, and toning the legs with resistance training; whereby the pants further including a pocket at the ankle for concealing the elastic bands when not in use; and whereby a pair of stirrup loop straps at the ankles that receive the feet to counterbalance the first direction pull on the elastic bands, so as to cause the muscles to contract against an external resistance with the expectation of increases in strength, tone, mass, and endurance.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known in the art that the core muscles of the body include: the abdominal muscles (transverse abdomens, rectus abdomens, internal oblique, and external oblique), hip flexor, gluteus muscle groups, and thoracic cavity musculature. Typically, athletes and non-athletes attempt to optimize the targeting of specific muscle groups in an efficient manner. There are exercise machines that target all of the muscles that comprise the core of the body, the core of the body being the center for all limb and trunk movements. Such exercise machines target the core muscles are useful because they enhance resistance to injuries while improving the user's balance, coordination, agility, and speed. Further, portable resistance devices are known in the art, but none have specifically targeted the inner most regions of the body, more specifically, the core muscles of the body.

Typically, athletic wear is donned for participating in sports and physical exercise, for practical, comfort or safety reasons. Typical sport-specific garments include tracksuits, shorts, T-shirts, and polo shirts. An athletic wear garment is designed for efficient resistance training and exercise. Those skilled in the art will recognize that resistance, or strength training is a type of physical exercise specializing in the use of resistance to induce muscular contraction which builds the strength, anaerobic endurance, and size of skeletal muscles. The resilient, form-fitting pants, and the elastic bands work together to create a synergy for the resistance training.

Other proposals have involved resistance training equipment and garments. The problem with these exercise devices is that they do not combine the advantages of the garment with the resistance equipment. Also, the resistance bands cannot be concealed when not in use. Even though the above cited resistance training equipment and garments meet some of the needs of the market, a wearable resistance exercise garment and method of resistance exercise that provides a pair of resilient pants for exercise that have elastic band extending from the ankle that a wearer can grasp at the free ends to pull the elastic bands in a first direction for exercising the upper body, and toning the legs with resistance training; whereby the pants further including a pocket at the ankle for concealing the elastic bands when not in use; and whereby a pair of stirrup loop straps at the ankles that receive the feet to counterbalance the first direction pull on the elastic bands, so as to cause the muscles to contract against an external resistance with the expectation of increases in strength, tone, mass, and endurance, is still desired.

SUMMARY

Illustrative embodiments of the disclosure are generally directed to a wearable resistance exercise garment and method of resistance exercise. The wearable athletic garment provides a pair of stretchy material athletic pants that have fixedly attached elastic bands at the ankle ends that allow a wearer to perform resistance exercises without additional equipment; whereby the wearer pulls one end of the bands in a first direction to generate an external resistance force that is counterbalanced by the weight and feet of the wearer.

In one embodiment, the wearable athletic garment provides a pair of resilient athletic pants for exercise that have elastic band extending from the ankle. The wearer can grasp at the free ends of the elastic bands to pull the elastic bands in a first direction for exercising the upper body, and toning the legs with resistance training. The athletic pants further including a pair of pockets at the ankle ends for concealing the elastic bands when not in use. A pair of stirrup loop straps at the ankles receive the feet to counterbalance the first direction pull on the elastic bands. This generated external resistance force causes the muscles to contract against an external resistance with the expectation of increases in strength, tone, mass, and endurance.

In one aspect, an athletic wear garment with concealable elastic workout band, comprises:

a pair of resilient pants operable to be worn by a wearer, the pants being defined by a stretchable surface, an upper waist section, and a pair of legs terminating at two ankle ends, the ankle ends forming openings, the ankle ends comprising a bottom hem, the bottom hem forming a tunnel;

a hook and loop fastener strap sewn at the ankle ends, the hook and loop fastener strap regulating the diameter of the ankle ends;

a pair of fastenable pockets being integral with the ankle ends of the pants, the fastenable pockets defined by an inner cavity;

a fastening mechanism operable with the fastenable pockets, the fastening mechanism regulating access to the inner cavity of the fastenable pockets;

a pair of elastic bands defined by a first end and a second end, the first end joined with the fastenable pockets, the second end terminating at a ring, the elastic bands being compactable into the fastenable pockets, the elastic bands being operable to be pulled in a first direction towards the upper waist section, whereby the pulling the elastic bands in the first direction generates an external resistance force along the longitudinal of the elastic bands, whereby the fixed attachment between the fastenable pockets and the first end of the elastic bands helps counterbalance the external resistance force generated by pulling the elastic bands in the first direction; and a pair of stirrup loop straps at the ankle ends, the stirrup loop straps extending across the openings formed at the ankle ends.

In a second aspect, the upper waist section is defined by a wide, foldable band.

In another aspect, the openings in the ankle ends enable passage of the ankles and the feet.

In another aspect, the stirrup loop straps receive the feet.

In another aspect, the feet prevent the ankle ends from moving in the first direction and help counterbalance the external resistance force generated by pulling the elastic bands in the first direction.

In another aspect, the hook and loop fastener strap regulates the snugness of the ankle ends around the ankles.

In another aspect, the ankle ends comprise a bottom hem, the bottom hem forming a tunnel.

In another aspect, the hook and loop fastener strap is sewn inside the tunnel that forms through the bottom hem of the ankle ends.

In another aspect, the fastenable pockets are disposed longitudinally with the legs of the pants.

In another aspect, the exercise pants further comprising a fastening mechanism operable with the fastenable pockets, the fastening mechanism regulating access to the inner cavity of the fastenable pockets.

In another aspect, the fastening mechanism closes the fastenable pockets when the elastic bands are inside the inner cavity.

In another aspect, the fastening mechanism comprises a zipper.

In another aspect, the first end of the elastic bands are fixedly attached to the pocket from inside the inner cavity.

In another aspect, the second end of the elastic bands terminate at a ring.

In another aspect, the elastic bands extend from the fastenable pocket to the upper waist section.

In another aspect, the pants, or the elastic bands, or both are double stitched.

In another aspect, the pants are athletic training pants.

In another aspect, the stretchable surface includes at least one of the following: a Ponte Roma material, a blend of cotton, lycra spandex, nylon, polyester, wool, and a light and stretchy synthetic material.

In another aspect, the fastening mechanism is a 7" zipper.

In another aspect, the pocket is blended into the pants.

In another aspect, the garment is double stitched.

One objective of the present invention is to provide a pair of stretchy material athletic pants that have fixedly attached elastic bands at the ankle ends that allow a wearer to perform resistance exercises without additional equipment; whereby the wearer pulls one end of the bands in a first direction to generate an external resistance force that is counterbalanced by the weight and feet of the wearer.

An exemplary objective is to provide elastic bands that integrate into a pair of athletic pants for resistance training.

Yet another objective is to enable the elastic bands to be concealed in the pockets at the ankle ends of the pant legs.

Another objective is to provide a machine washable pants.

Yet another objective is to provide elastic bands having sufficient length to enable a variety of resistance exercises.

Another objective is to provide an aesthetic athletic warm up pants.

An exemplary objective is to provide an inexpensive to manufacture athletic wear garment having elastic bands for resistance training.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 2A is a front view and FIG. 2B is a rear view, in accordance with an embodiment of the present invention;

FIG. 5A shows wearer grasping both rings while pivoting on the balls of the feet, so as to strengthen the calves and lower legs in general. FIG. 5B shows the wearer grasping the elastic bands in a cross-position while holding the feet, and thereby the first end of elastic bands steady on the ground, so as to strengthen the arms and general upper body region. FIG. 5C shows the wearer tying the second end of elastic bands to a mounted object and lifting the legs for leg strengthening exercises. FIG. 5D shows the wearer grasping both rings while pivoting on the balls of the feet, so as to strengthen the calves and lower legs in general, in accordance with an embodiment of the present invention;

FIG. 6A shows the upper waist band folded over, and FIG. 6B shows the upper waist band fully extended, in accordance with an embodiment of the present invention;

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A wearable resistance exercise garment and method of resistance exercise is referenced in FIGS. 1-17. The wearable resistance exercise garment, hereafter "garment" provides a pair of resilient athletic pants 102, often used in athletic training exercises, in a fixed, resilient relationship with a pair of elastic bands 118*a*, 118*b* that extend from the ankle ends 126*a-b* of the pants 102. The elastic bands 118*a-b* are configured for resistance training, and can be pulled towards the head of the wearer to generate an external resistance force, as the weight of the wearer, and the attachment of stirrup loop straps at the feet counterbalance the puling motion in the first direction 500. After exercise, the elastic bands 118*a-b* are easily stowed and concealed in pockets 112*a*, 112*b* that form in ankle ends 126*a-b* of pants 102.

Figure 1:
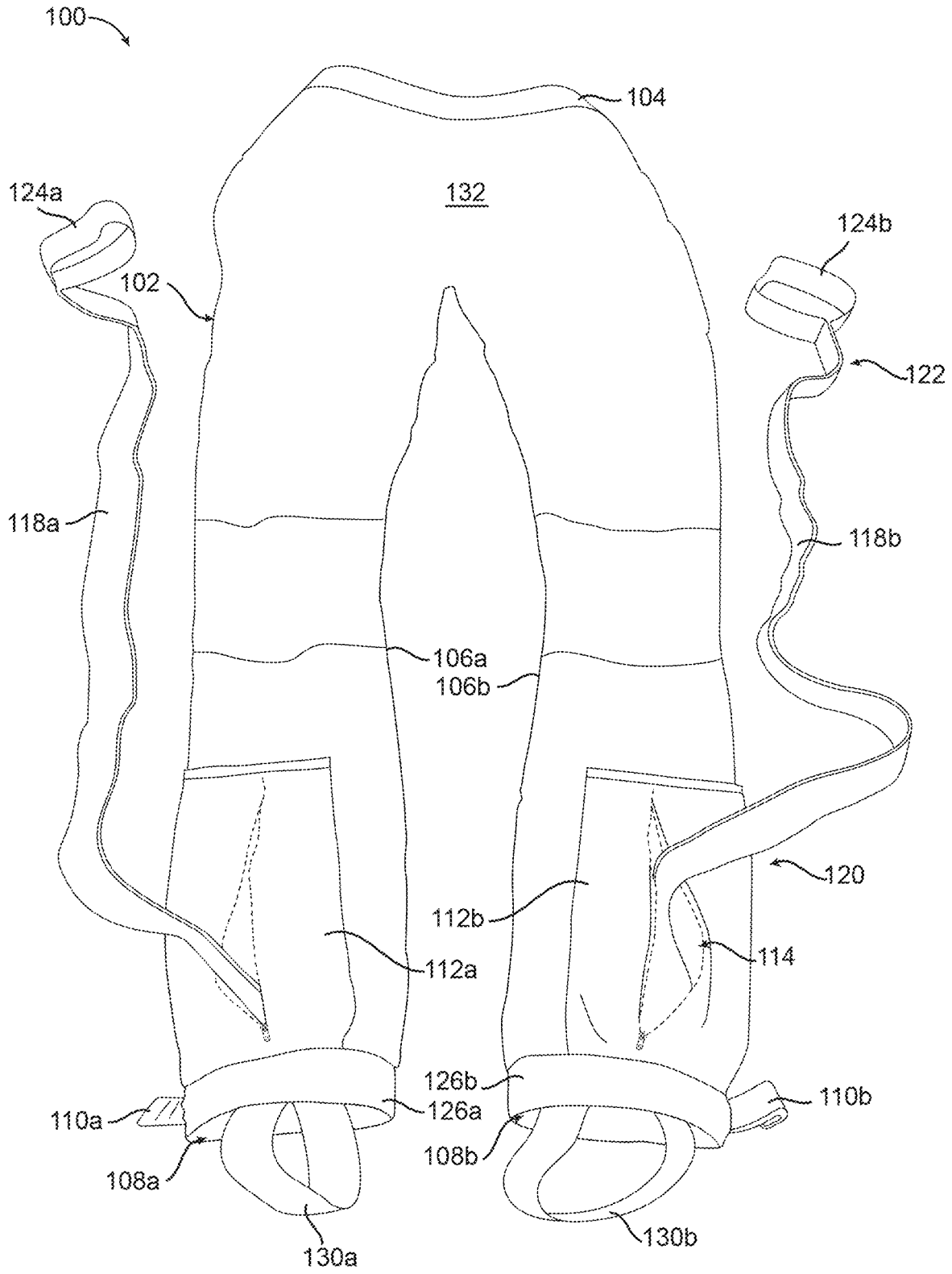
FIG. 1 illustrates a perspective view of an exemplary wearable resistance exercise garment with concealable elastic workout bands, in accordance with an embodiment of the present invention.

Looking at FIG. 1, garment 100 comprises a pair of resilient athletic training pants 102 that are operable to be worn by a wearer. Pants 102 being are defined by a stretchable surface 132, such as those used in yoga pants, and other athletic garment 100*s* known in the art. In one embodiment, pants 102 are flexible, form-fitting pants designed for physical workouts, running, the practice of yoga, and other physical activities that involve movement, bending, and stretching. In some embodiments, pants 102 may be worn for sports and physical exercise, martial arts, dancing, Pilates, or aerobics. In some embodiments, pants 102 may be fabricated from a Ponte Roma material, a blend of cotton, lycra spandex, nylon, polyester, wool, a light and stretchy synthetic material, or a combination thereof.

Figure 2A:
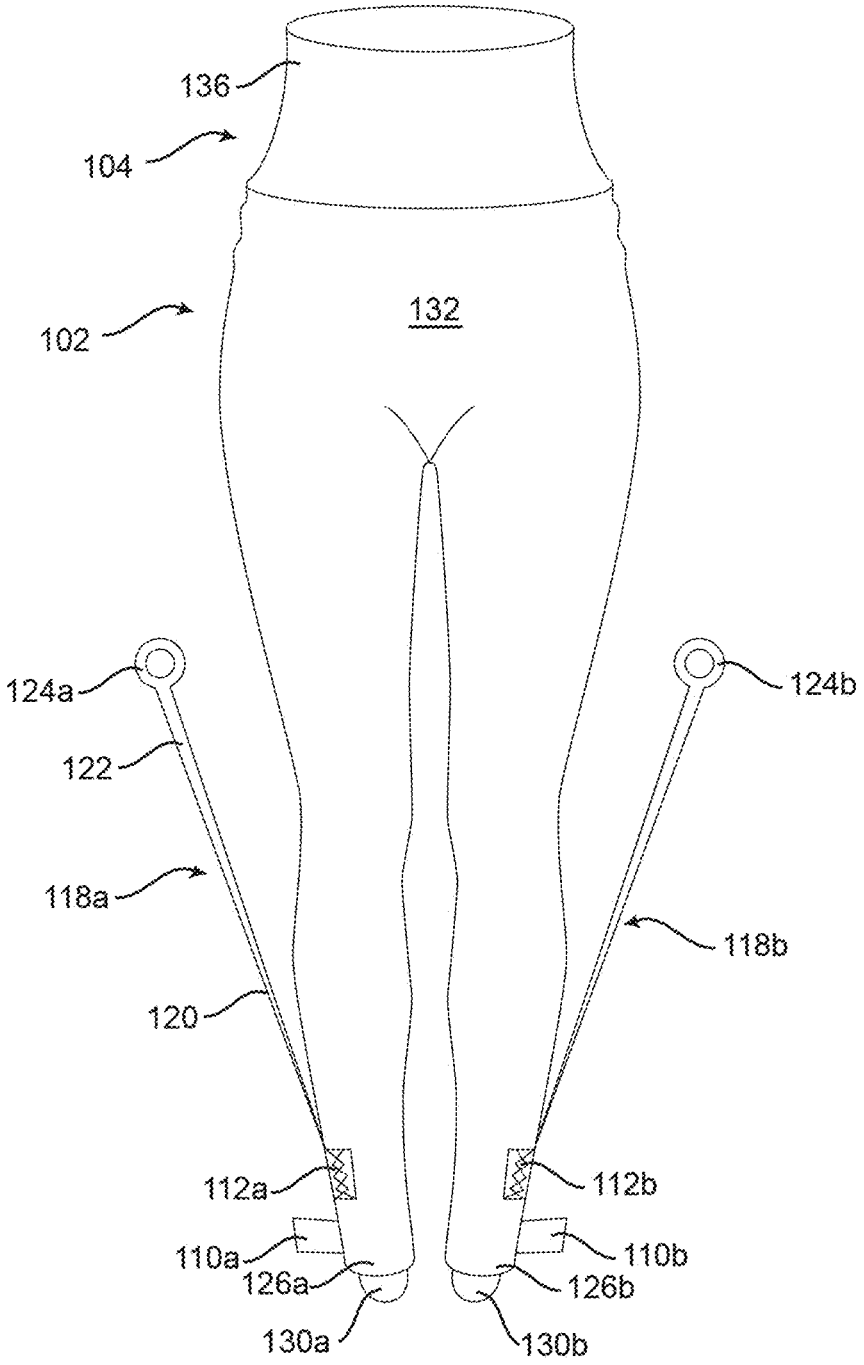
FIGS. 2A and 2B illustrate the athletic pants of the wearable resistance exercise garment, where
Figure 6A:
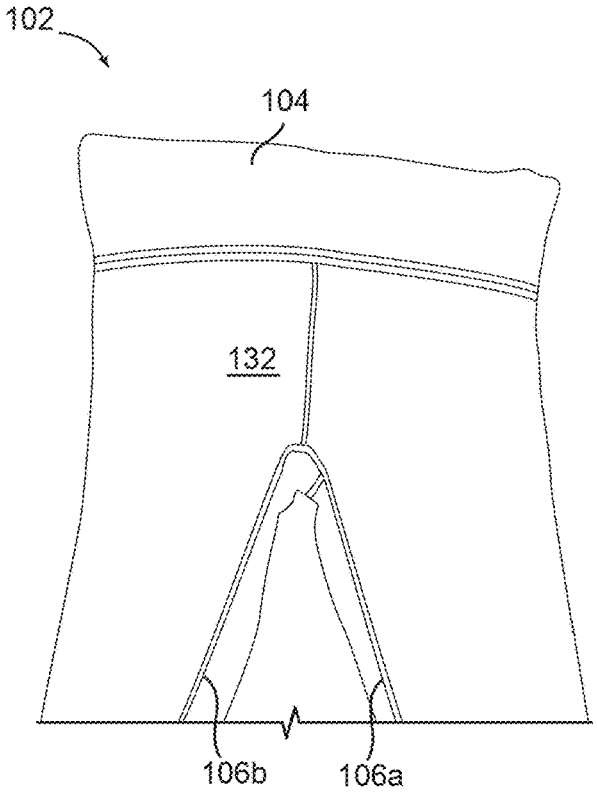
FIGS. 6A and 6B illustrates a perspective view of an exemplary upper waist band, where
Figure 6B:
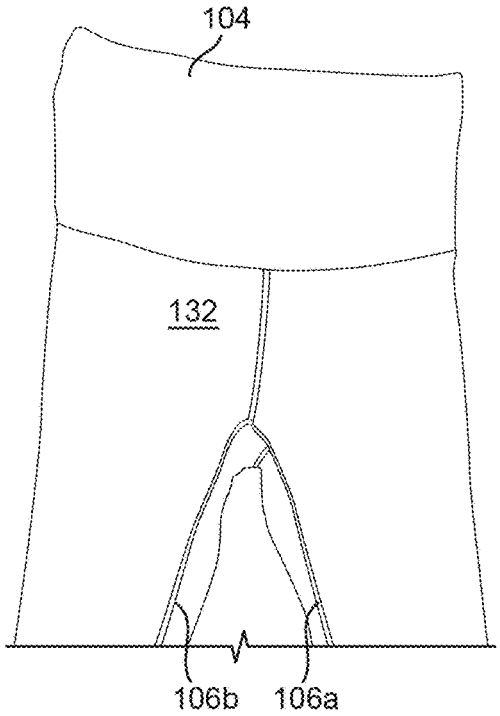

As illustrated in FIG. 2A, pants 102 are defined by an upper waist section having a wide, foldable band 136, and a body section that runs longitudinally to a pair of legs terminating at two ankle ends 126*a*, 126*b*. Upper waist section 104 forms a restrictive band around the waist of wearer to maintain pants 102 against the abdomen and waist. As FIG. 6A shows, upper waist section 104 folded over to accommodate different sizes of waists. Upper waist section 104 may also be folded over to create additional tension around the abdomen. Upper waist section 104 may also be folded over to create comfort for the wearer. However, wearer may also extend upper waist section 104 for a more natural look (FIG. 6B).

In one embodiment, upper waist section 104 may utilize double materials, or may have an additional elastic piece integrated therein to provide greater snugness around the waist. In some embodiments, upper waist section 104 may be 5½" wide. Though in other embodiments, other sizes may also be used.

Ankle ends at the terminus of the pant legs are sized and dimensioned to form openings that enable passage of the ankles and the feet. Ankle ends comprise a bottom hem 128 that folds, and in some embodiments, forms a tunnel 134. Hem 128, may be double stitched and create an ornamental, designer effect to pants. Tunnel 134 that forms in hem is useful for retaining a hook and loop fastener strap, as described below.

Figure 7:
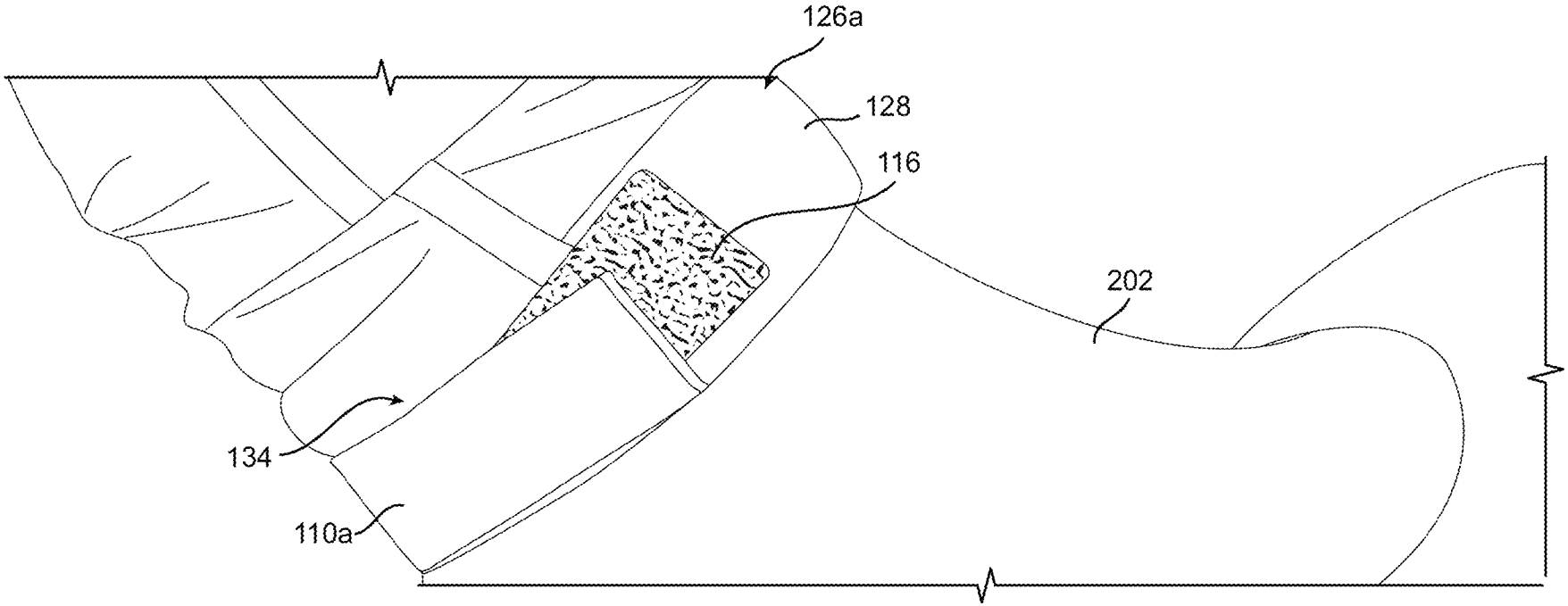
FIG. 7 illustrates a close up view of a hook and loop strap wile fastening the ankle end around the ankle of the wearer, in accordance with an embodiment of the present invention.

In some embodiments of garment 100, a hook and loop fastener strap 110*a*, 110*b* is sewn at each ankle end 126*a*, 126*b* of pants 102. FIG. 7 illustrates a close up view of a hook and loop strap 110*a-b* wile fastening the ankle end around the ankle of the wearer. Hook and loop fastener strap regulates the diameter of the ankle ends by squeezing around the ankles. Hook and loop fastener strap 110*a*, 110*b*, i.e., Velcro straps, is sewn inside tunnel 134 at the bottom hem 128 of ankle ends 126*a*, 126*b*. Hook and loop fastener strap 110*a-b* works to regulate the snugness of the openings 108*a*, 108*b* around the ankle 200.

Figure 8:
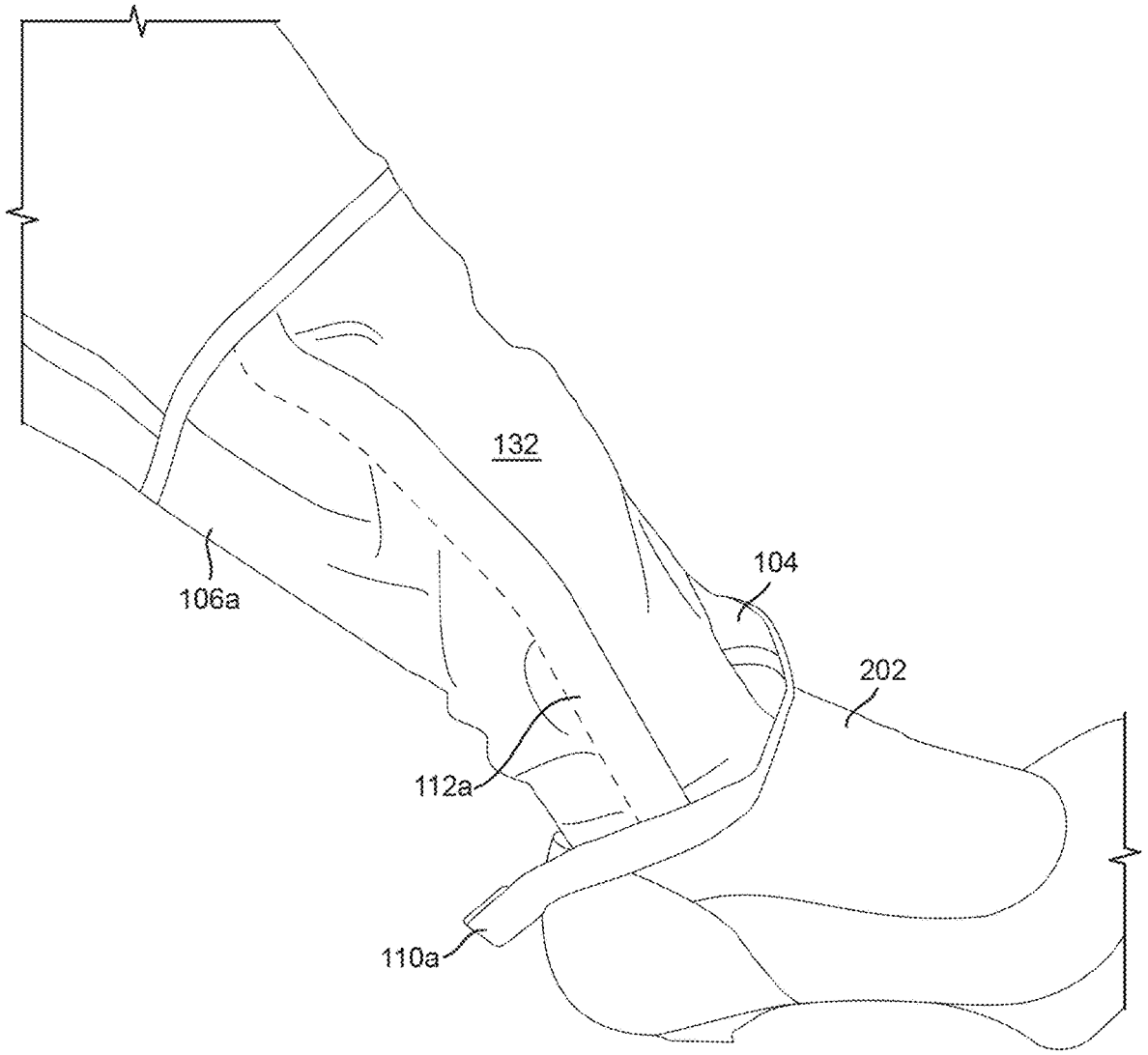
FIG. 8 illustrates a perspective view of a leg of the pants with the elastic band concealed in the pocket, in accordance with an embodiment of the present invention.

As shown in FIG. 8, hook and loop fastener strap 110*a-b* that is sewn, welded, or otherwise affixed inside a tunnel 134 at the bottom hem 128 of ankle ends 126*a-b*. Hook and loop fastener strap 110*a-b* is manipulated to regulate the snugness of the openings 108*a-b* around the ankle 200. For example, wrapping the strap around the ankle 200 and engaging the hook and loop fastener wraps the ankle ends 126*a-b* around the ankle 200 in a snug configuration.

Garment 100 may further include a pair of fastenable pockets 112*a*, 112*b* that are integral with the ankle ends of the pants. In one non-limiting embodiment, the fastenable pockets being disposed longitudinally with the legs of the pants. The fastenable pockets are defined by an inner cavity. A fastening mechanism is operable with the fastenable pockets, for opening and closing the inlet in the fastenable pockets. The fastening mechanism regulates access to the inner cavity of the fastenable pockets.

Figure 2B:
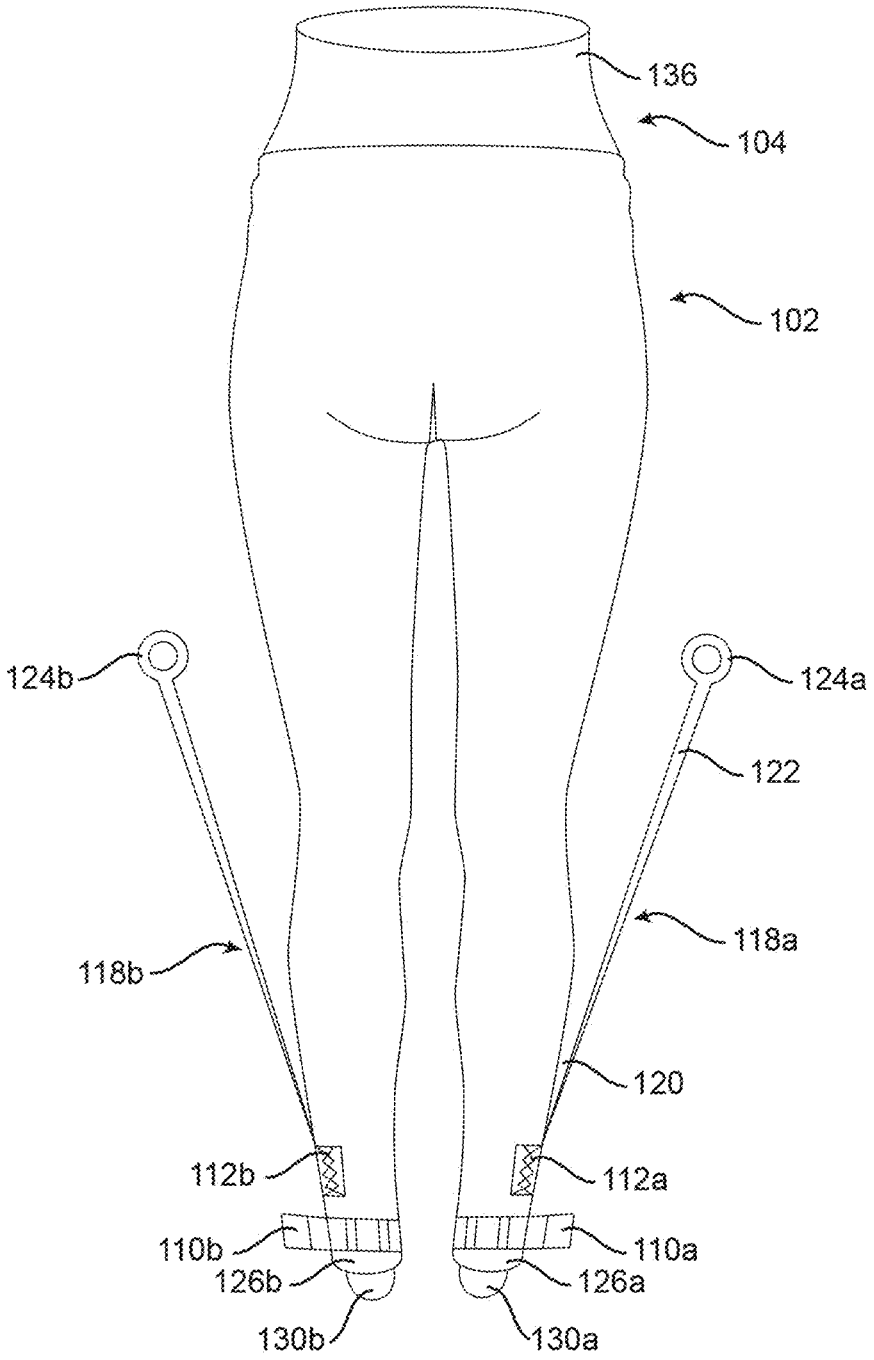

Looking at the rear view of garment 100, shown in FIG. 2B, pocket 112*a-b* includes a fastening mechanism 116, such as a 7" zipper. Fastening mechanism 116 is configured to be manipulated by wearer of pants 102 to easily regulate access to the inner cavity 114 of pocket 112*a-b*. Fastening mechanism 116 may be opened to extend from inside the pocket 112*a-b*, or stow the bands in the inner cavity 114 of the pocket 112*a-b*. Fastening mechanism 116 may also be closed to secure the bands inside pocket 112*a-b*, and also to give the appearance of a fashionable athletic wear pants 102.

A primary component of the present invention are a pair of elastic bands 118*a-b* operable with pants 102, and configured for resistance training. Elastic bands 118*a*, 118*b* are integral to the pants 102, working to create a synergy with the pants 102 for optimal resistance training. It is significant to note that elastic bands 118*a*, 118*b* are also useful for physical therapy, specifically by convalescents of muscular injuries, including cardiac rehab patients to allow slow rebuilding of strength.

In some embodiments, elastic bands 118*a*, 118*b* may be fabricated from synthetic rubber or natural rubber. Elastic bands 118*a*, 118*b* have a predefined resistance level to accommodate different resistances. In one alternative embodiment, elastic bands 118*a*, 118*b* are color coded to show different levels of resistance. Elastic bands 118*a*, 118*b* may be interchanged within pockets 112*a-b* to change the resistance level.

Figure 9:
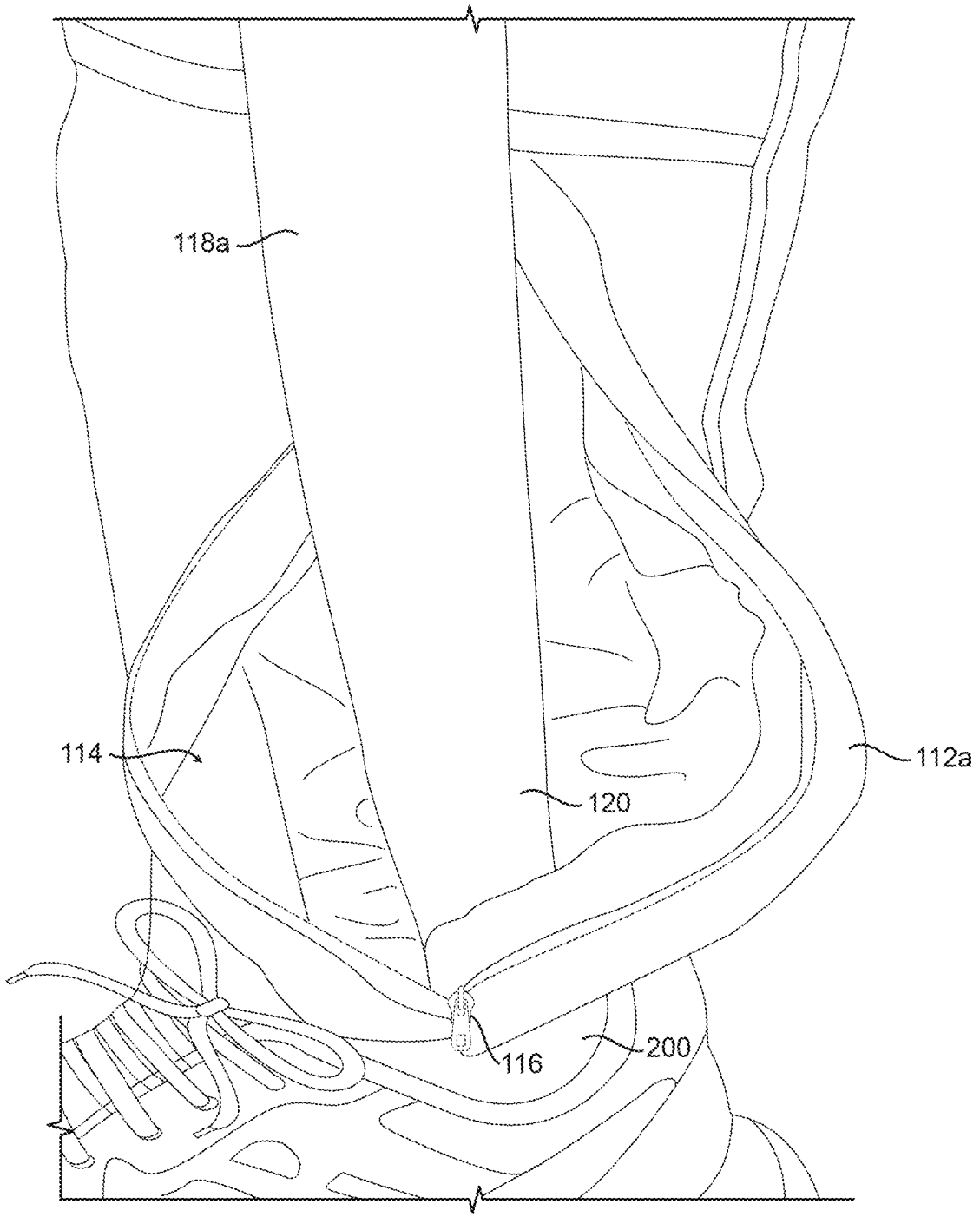
FIG. 9 illustrates a close up view of a leg of the pants with the first end of the elastic band fixedly attached to the fastenable pocket, in accordance with an embodiment of the present invention.

Elastic bands are defined by a first end 120 that is distal from the head of the wearer, and a free second end 122 that is proximal to the head of the wearer and graspable for pulling and manipulating for resistance training. First end 120 of elastic bands 118*a-b* fixedly attaches to the fastenable pockets. FIG. 9 illustrates a close up view of a leg of the pants with the first end 120 of elastic band fixedly attached to inside of fastenable pocket.

In one possible embodiment, the second end 122 of elastic bands terminates at a ring that can be easily grasped by wearer while performing resistance exercises. Further, elastic bands are resilient, and thereby compactable into the fastenable pockets. This allows for convenient stowage and concealment of the elastic bands 118*a-b*, as described below. In one non-limiting embodiment, elastic bands 118*a-b* are double stitched. Elastic bands 118*a*, 118*b* may be defined by a large squared design at a lower section (from the knee down) for added fashion.

Figure 3:
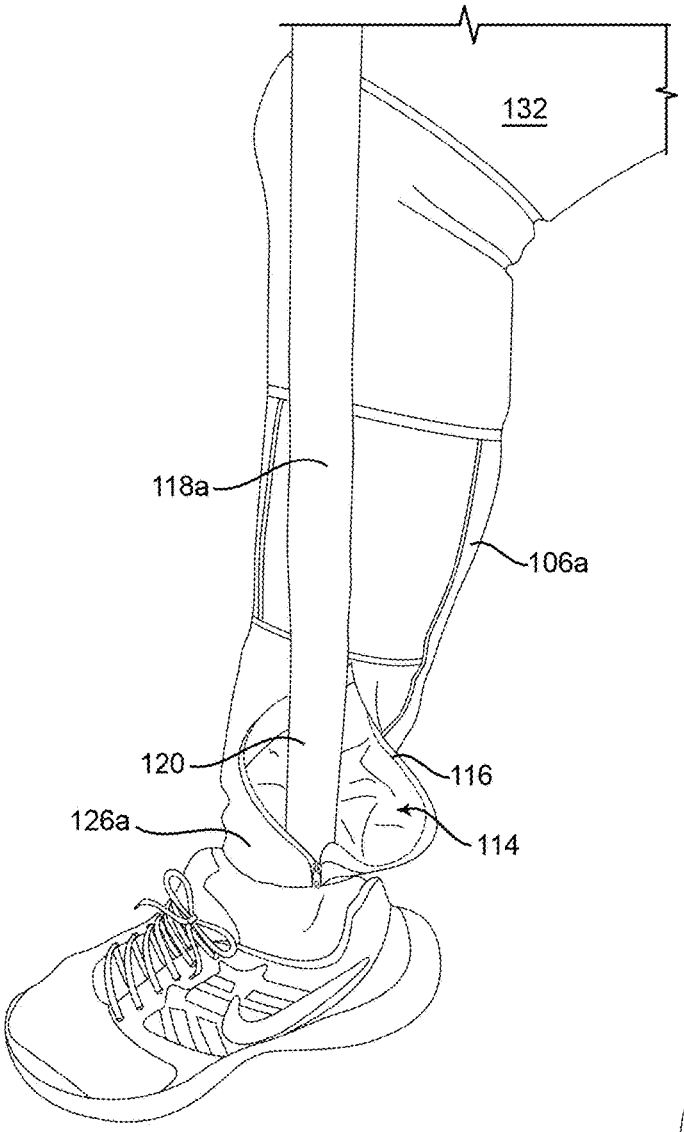
FIG. 3 illustrates a perspective view of a leg of the pants with the elastic band extended during exercise, in accordance with an embodiment of the present invention.

As FIG. 3 shows, elastic bands 118*a-b* are configured to extend and retract in relation to pockets 112*a-b*. When fully stretched, elastic bands 118*a-b* run up a substantial length of the pant legs 106*a-b*, generally beyond the upper waist section 104. From their second end 122, elastic bands 118*a-b* are grasped at the rings 124*a*, 124*b* and manipulated, working against the weight of the wearer and resistance from the legs 106*a-b* of the wearer.

In exercise operation, elastic bands 118*a-b* are operable to be pulled in a first direction 500 towards the upper waist section. First direction 500 is defined as a vector from the ankle ends towards the upper waist section, or the head, or distally, from the wearer. In this manner, pulling the elastic bands in the first direction generates an external resistance force along the longitudinal of the elastic bands. The fixed attachment between the fastenable pockets and the first end of the elastic bands helps counterbalance the external resistance force generated by pulling the elastic bands in the first direction 500.

Figure 4:
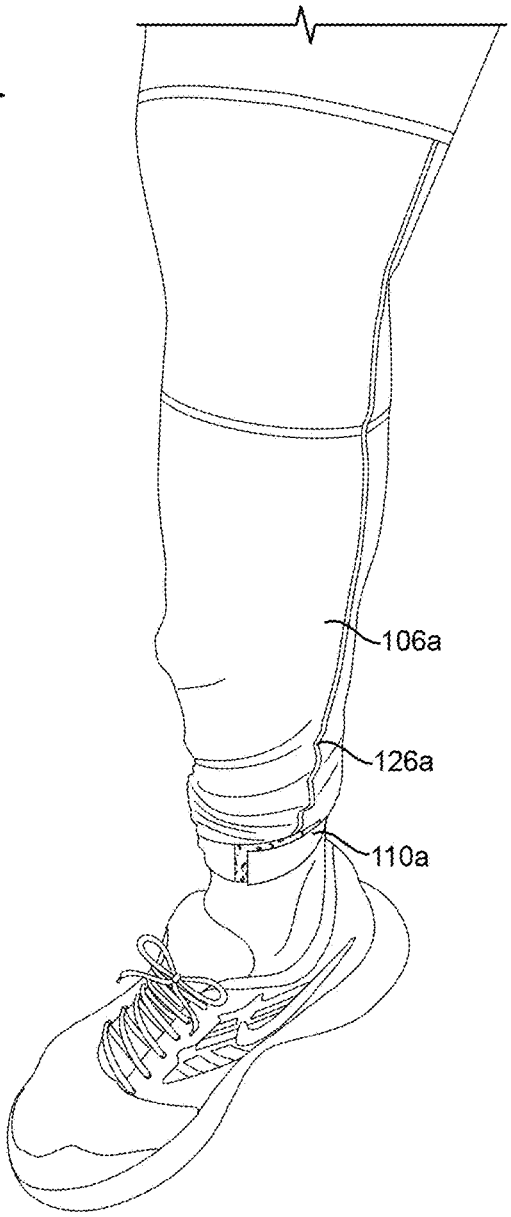
FIG. 4 illustrates a perspective view of a leg of the pants with the elastic band concealed in a pocket during exercise, in accordance with an embodiment of the present invention.
Figure 10:
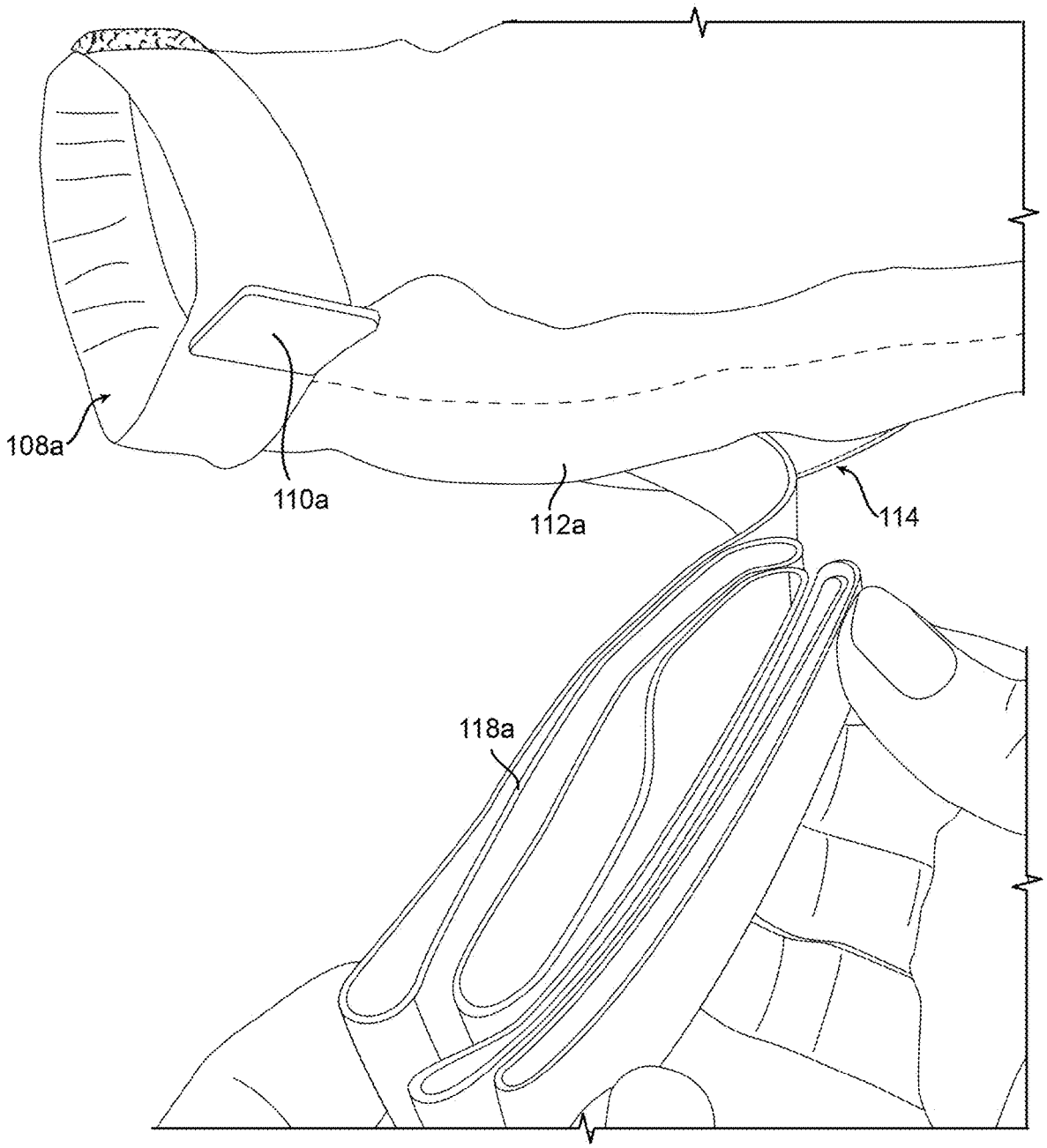
FIG. 10 illustrates a perspective view of elastic bands outside the pockets and folded for entry into the pocket, in accordance with an embodiment of the present invention.
Figure 11:
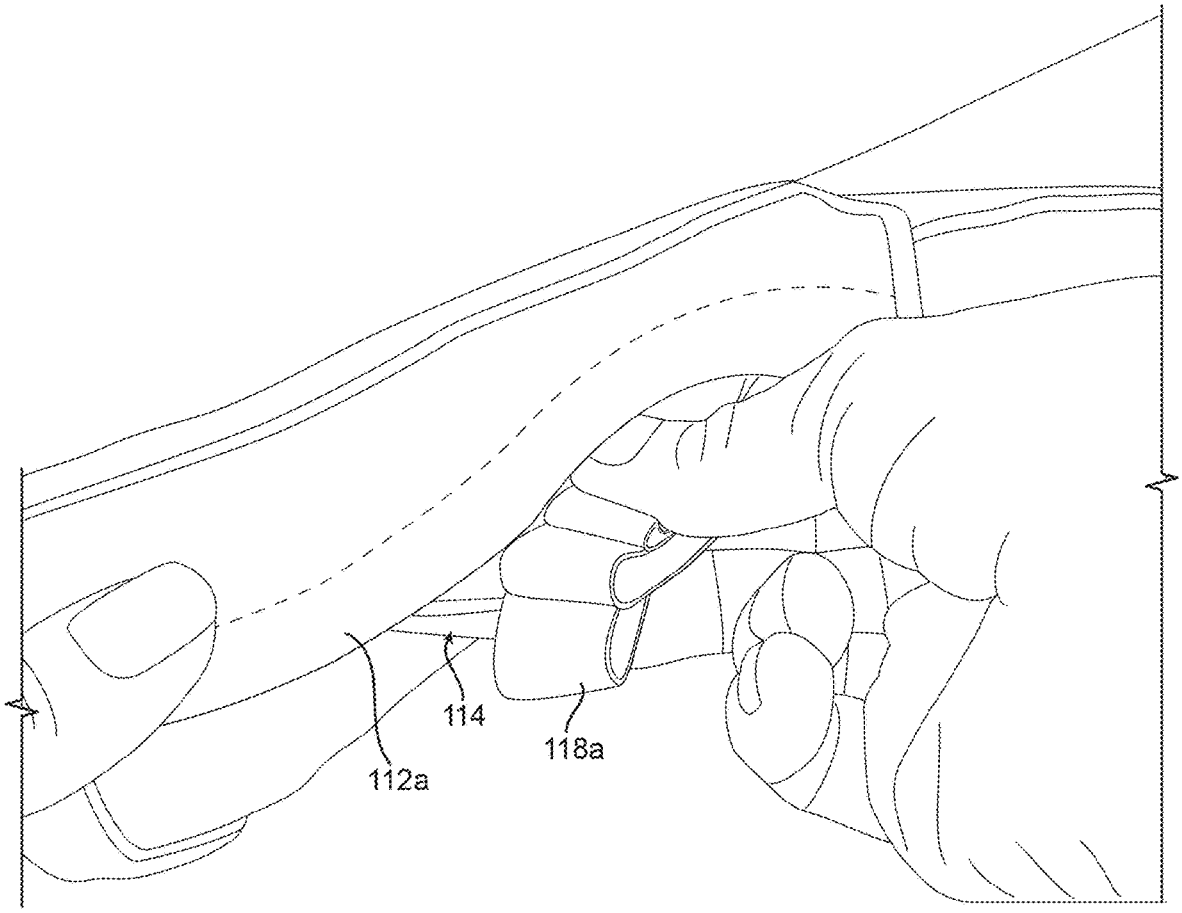
FIG. 11 illustrates a perspective view of elastic bands retracting into inner cavity of the pockets, in accordance with an embodiment of the present invention.

However, when not in use, elastic bands 118*a-b* are tucked into their respective pockets 112*a-b*. FIG. 10 illustrates a perspective view of elastic bands outside the pockets and folded for entry into the pocket. While elastic bands are tucked into pockets 112*a-b*, the wearer can then wear the garment 100, while elastic bands 118*a-b* remain securely stowed in a concealed, nonoperational position (FIG. 4). As FIG. 11 illustrate, elastic bands 118*a*, 118*b* retract into the inner cavity 114 of pockets 112*a-b*.

Figure 12:
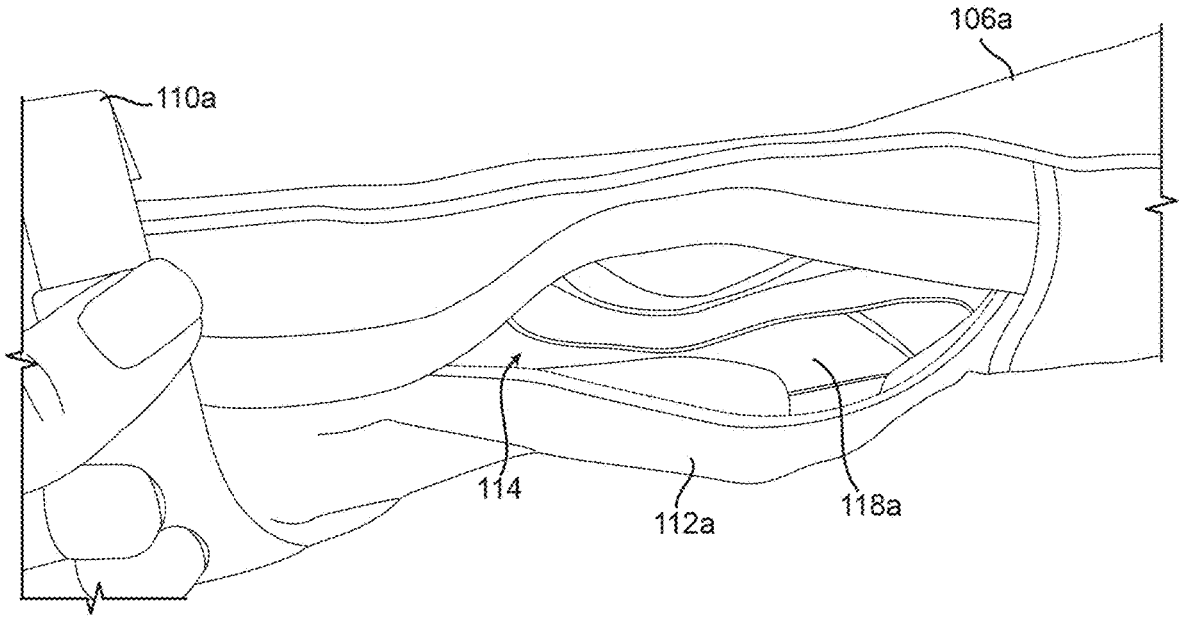
FIG. 12, illustrates a perspective view of the pocket having a flap and a fastening mechanism that encapsulate elastic bands for secure stowage in the inner cavity, in accordance with an embodiment of the present invention.
Figure 13:
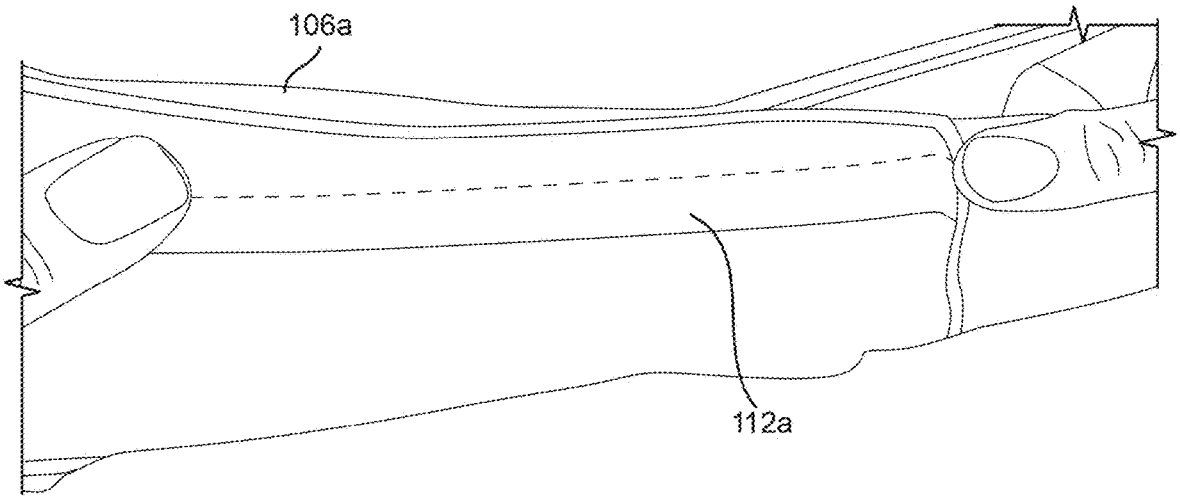
FIG. 13 illustrates a perspective view of the elastic band fully stowed inside the inner cavity of pocket, and fastening mechanism closing the pocket, in accordance with an embodiment of the present invention.

Looking at FIG. 12, the pocket has a flap and a fastening mechanism 116 that encapsulate elastic bands 118*a* for secure stowage in the inner cavity 114. Once, elastic band is stowed inside the inner cavity 114 of pocket, fastening mechanism 116 closes pocket 112*a-b* (FIG. 13). Thus, the elastic bands 118*a-b* may be securely stowed while pants 102 are worn in normal daily wear. While stowed in such a manner, the user can wear pants 102 without it being apparent that elastic bands 118*a-b* are attached thereto.

Looking back at FIG. 1, the garment 100 also includes pair of stirrup loop straps 130*a*, 130*b* disposed at the ankle ends 126*a-b*. Stirrup loop straps 130*a-b* extend across the openings formed at the ankle ends. This allows stirrup loop straps 130*a-b* to receive the feet when the pants are donned. The feet prevent the ankle ends from moving in the first direction and help counterbalance the external resistance force generated by pulling the elastic bands in the first direction.

Stirrup loop straps 130*a-b* provide an anchor for the foot to create greater leverage, and thereby resistance, when pulling the bands. Stirrup loop straps 130*a-b* resist the directional force of the elastic bands being pulled in the first direction—in essence serving as an anchor. In some embodiments, stirrup loop straps 130*a-b* may be fabricated from a Ponte Roma material, a blend of cotton, lycra spandex, nylon, polyester, wool, a light and stretchy synthetic material, or a combination thereof.

In exercise operation, FIGS. 5A-5D illustrate how a wearer can optimize resistance training with garment 100. Firstly, wearer grasps the rings 124*a*, 124*b* at second end 122 of elastic bands 118*a-b* and manipulate elastic bands 118*a*, 118*b* for exercising the upper body, toning the legs 106*a*, 106*b* with resistance training, and myriad other combinations of upper and lower body exercises.

For example, second end 122 of the band is pulled in the first direction 500, thereby generating an external resistance force along the longitudinal of the band. Those skilled in the art will recognize that this type of resistance training with elastic bands is possible because the elastic bands 118*a*, 118*b* work against the weight and muscle resistance of the legs 106*a*, 106*b*. Further, the length of the elastic bands 118*a*, 118*b* are not restrictive, but can stretch, fold, and wrap around the legs 106*a*, 106*b*, upper body, or exercise equipment. Further, the wearer can hold and manipulate the elastic bands 118*a*, 118*b* at a desired resistance position along their length to add or reduce resistance. Elastic bands 118*a*, 118*b* may be interchanged within pockets 112*a-b* to change the resistance level.

Figure 5A:
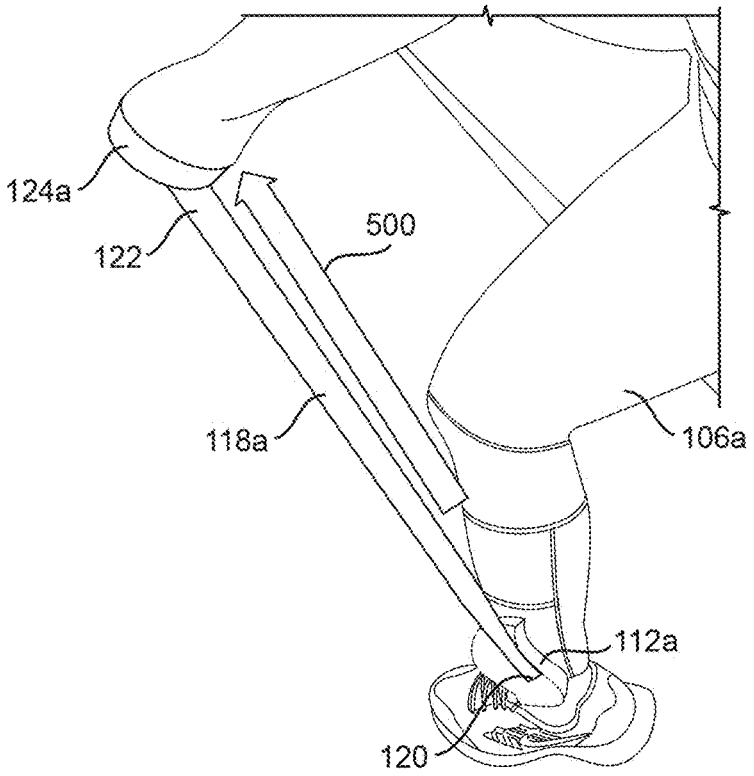
FIGS. 5A-5D illustrate a perspective view of a wearer manipulating elastic bands during resistance exercises, where
Figure 5B:
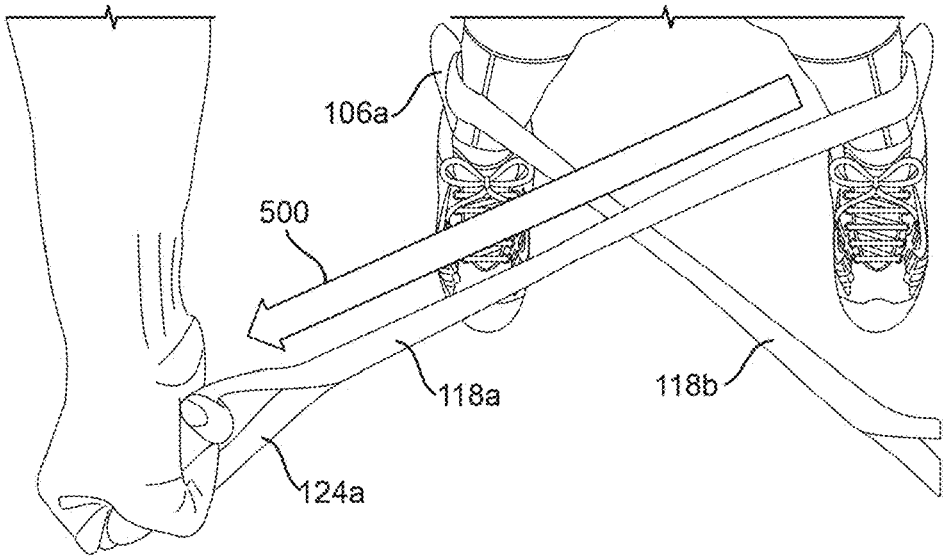
Figure 5C:
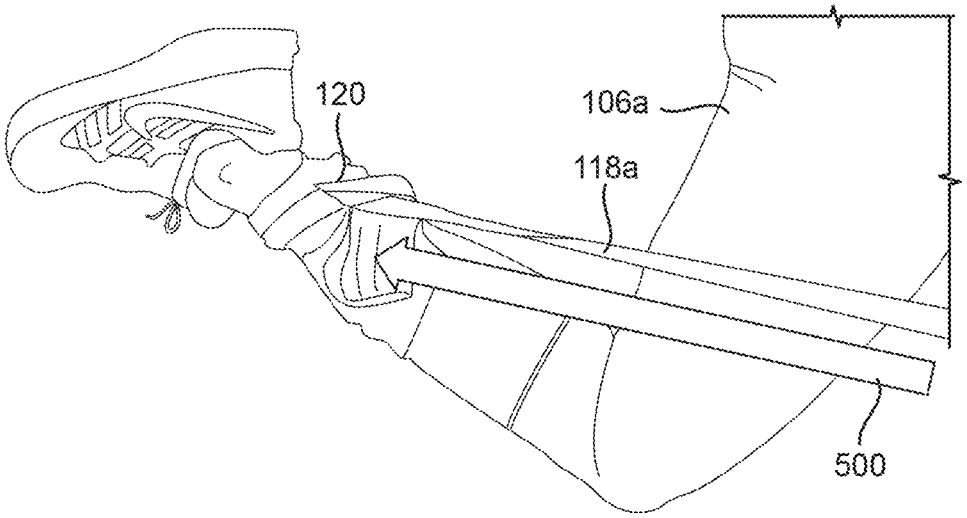
Figure 5D:
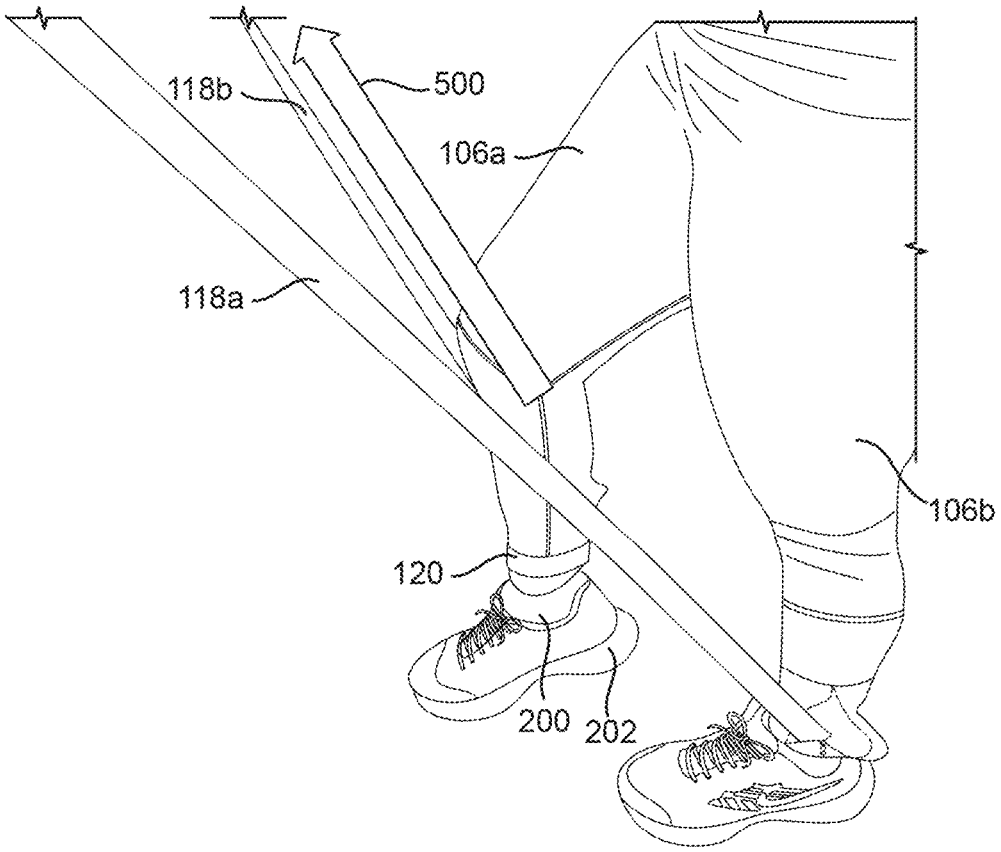

For example, FIG. 5A shows wearer grasping both rings 124*a*, 124*b* while pivoting on the balls of the feet 202, so as to strengthen the calves and lower legs in general. FIG. 5B shows the wearer grasping the elastic bands in a cross-position while holding the feet, and thereby the first end 120 of elastic bands 118*a-b* steady on the ground, so as to strengthen the arms and general upper body region. FIG. 5C shows the wearer tying the second end 122 of elastic bands to a mounted object and lifting the legs in first direction 500 for leg strengthening exercises. FIG. 5D shows the wearer grasping both rings 124*a*, 124*b* while pivoting on the balls of the feet 202, so as to strengthen the calves and lower legs in general. Wearer pulls the elastic bands 118*a-b* in first direction 500 while standing on balls of feet.

In conclusion, a wearable resistance exercise garment 100 and method of resistance exercise provides stretchy material athletic pants with a pair of elastic bands 118*a-b* attached at the ankle ends of the pants 102 for performing resistance exercises. In operation, the wearer pulls one end of the elastic bands in a first direction to generate an external resistance force that is counterbalanced by the weight of the wearer, and the fixed attachment to the ankle ends of the pants. Pants have an upper waist section and a pair of legs terminating at two ankle ends.

The ankle ends form openings that enable passage of the feet. A hook and loop fastener strap regulates the snugness around the ankle. A fastenable pocket forms at ankle ends. Elastic bands have a first end fixedly attach to the pocket, and a second end that can be grasped by the wearer. The bands are pulled in first direction and manipulated for resistance training. When not in use, the bands are tucked into their respective pockets and the pocket is closed with a pair of hook and loop fasteners.

Figure 14:
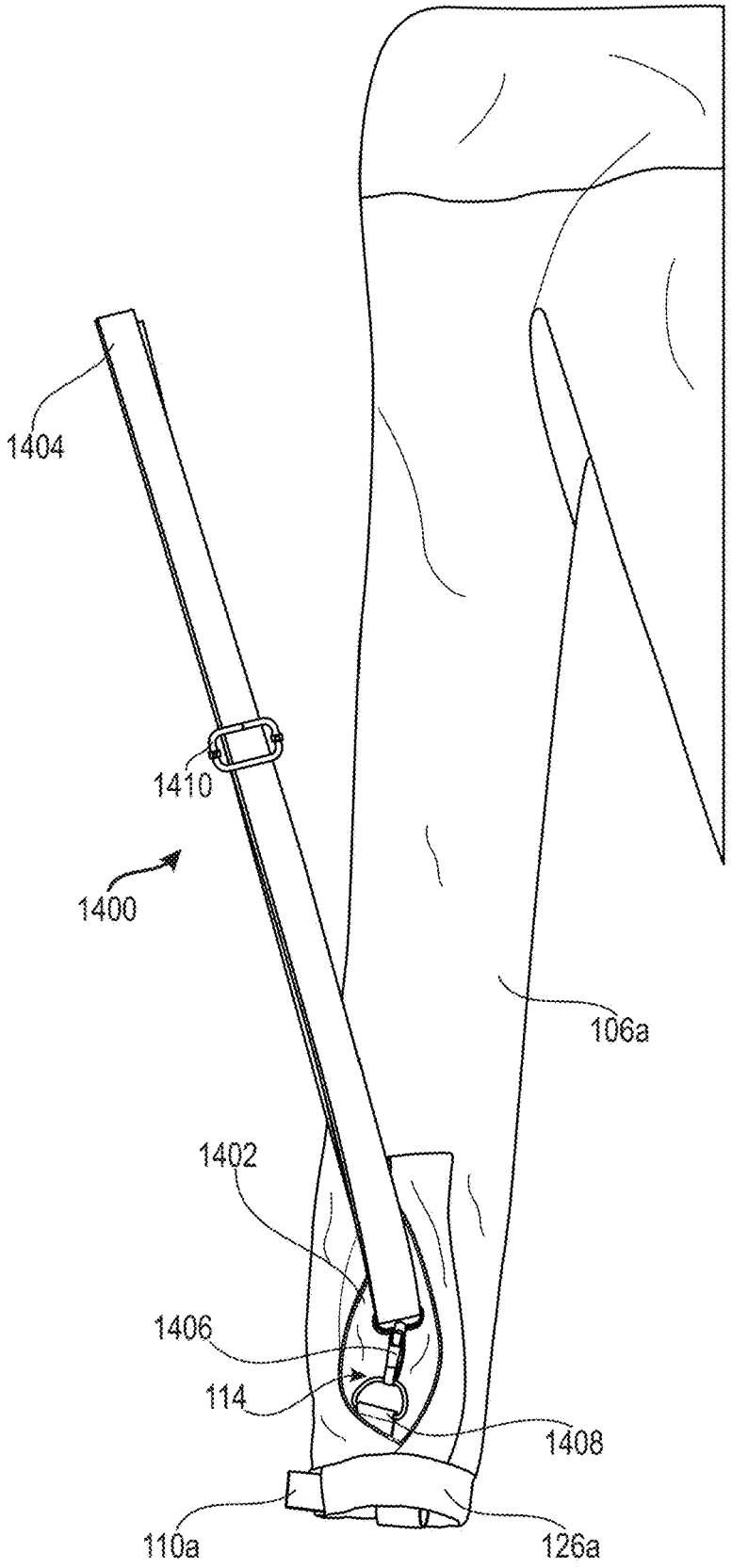
FIG. 14 illustrates a perspective view of an alternative embodiment of a pair of length adjustable and detachable elastic bands extending a substantial length of the pant legs, in accordance with an embodiment of the present invention.

FIG. 14 illustrates an alternative embodiment of a pair of length-adjustable, detachable elastic bands 1400*a*, 1400*b* extending a substantial length of the pant legs 106*a-b*, generally beyond the upper waist section 104. Elastic bands 1400*a-b* have a first end 1402 and a second end 1404. As in the above-disclosed elastic bands, length-adjustable, detachable elastic bands 1400*a-b* are configured to be grasped at rings from second end 1404 and manipulated, working against the weight of the wearer and resistance from the legs 106*a-b* of the wearer. The alternative embodiment of a pair of length-adjustable, detachable elastic bands 1400*a*, 1400*b* are defined by a unique capacity to detach from pants through a clip member 1406, such as a heavy-duty, swiveling spring clip.

Figure 15:
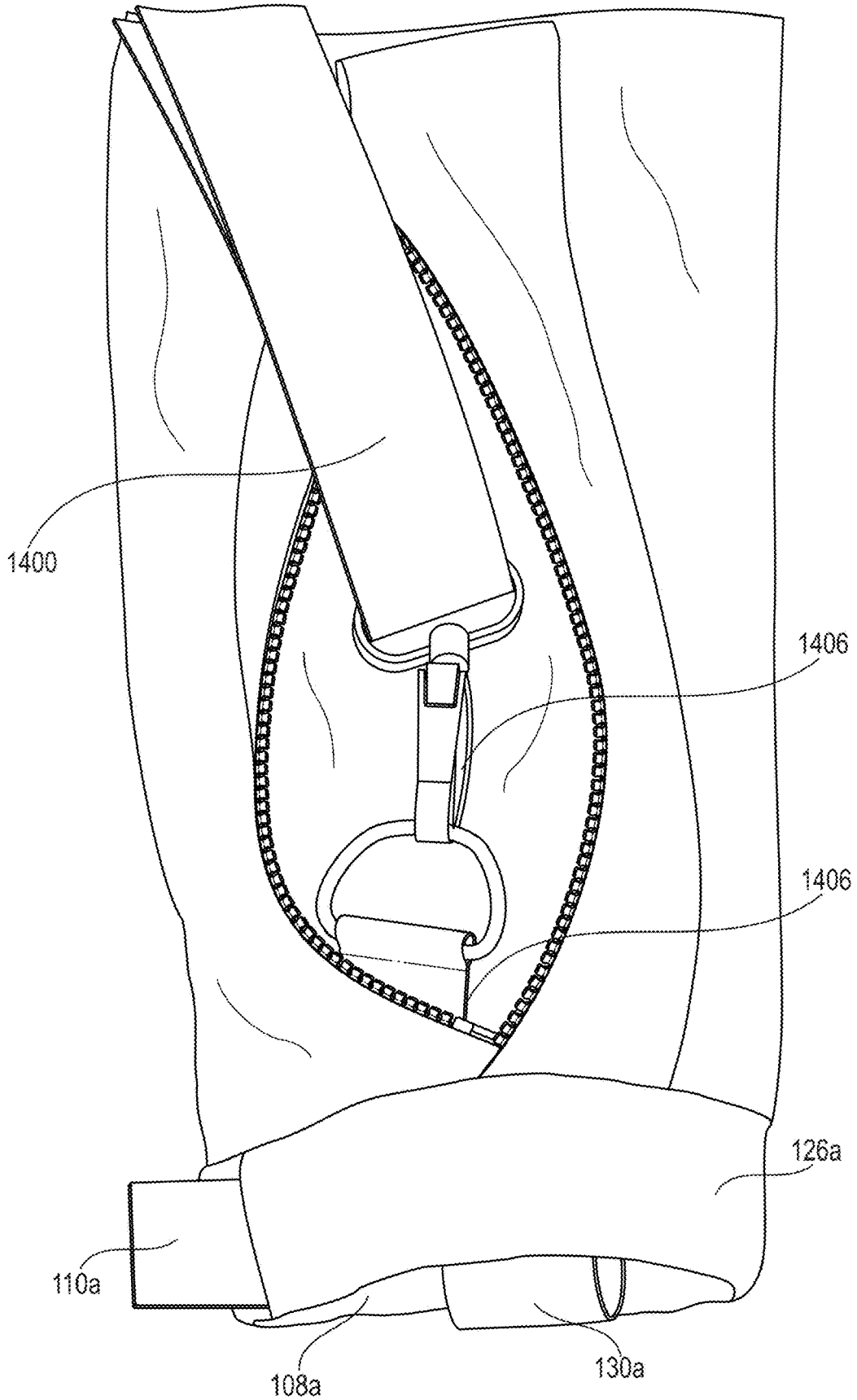
FIG. 15 illustrates a perspective view of an exemplary clip member, in accordance with an embodiment of the present invention.
Figure 16:
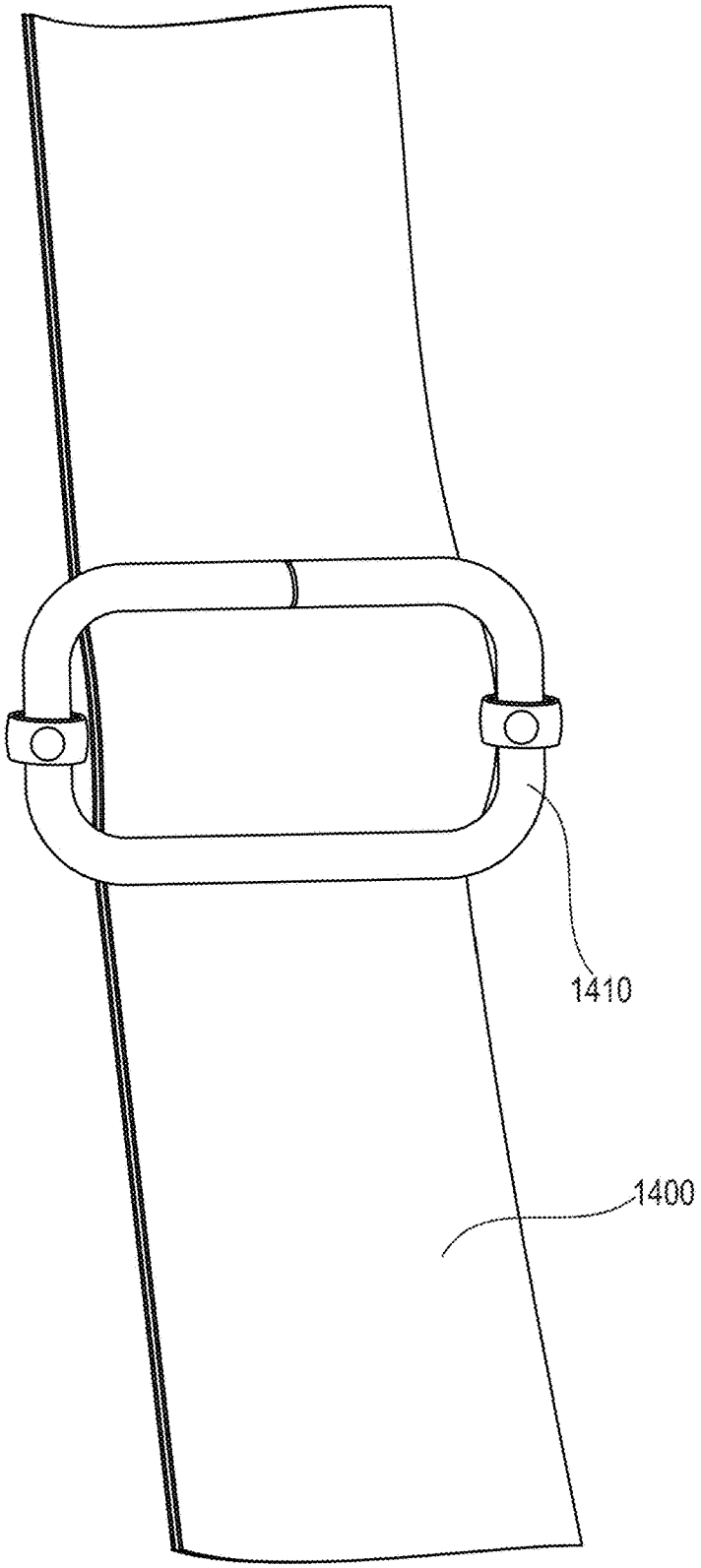
FIG. 16 illustrates a close-up view of an exemplary slide buckle, in accordance with an embodiment of the present invention.

At first end 1402 of length-adjustable, detachable elastic bands 1400*a-b*, the clip member 1406 detachably attaches elastic bands 1400*a-b* to an anchor member 1408 that anchors inside inner cavity 114 of pocket 112*a-b*—at ankle ends 126*a-b* of pants 102. In one non-limiting embodiment, anchor member 1408 comprises a metal hoop (FIG. 15). This allows length-adjustable, detachable elastic bands 1400*a-b* to be detached completely from the pants. In one non-limiting embodiment, clip member 1406 comprises a heavy-duty spring clip attached to a swiveling connector. Looking now at close-up view of FIG. 16, the pair of length-adjustable, detachable elastic bands 1400*a*, 1400*b* include a slide buckle 1410. Slide buckle is a flat buckle that receives length of elastic belt 1400*a-b* through a slot. Slide buckle 1410 is configured to slide along the longitudinal of elastic bands 1400*a-b*. Slide buckle 1410 enables elastic bands 1400*a-b* to be length adjusted.

Figure 17:
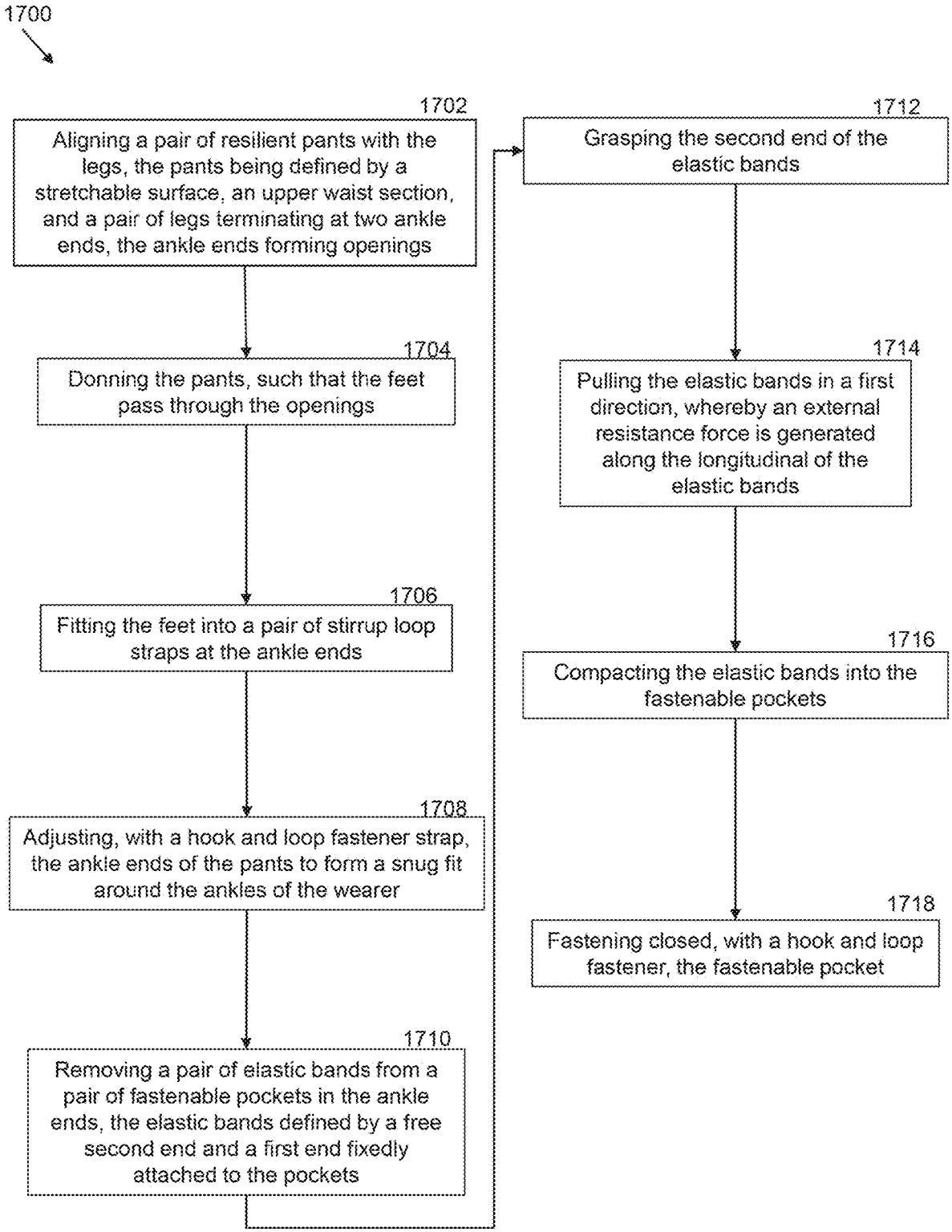
FIG. 17 illustrates a flowchart of an exemplary method for resistance exercise with a resistance exercise garment.

FIG. 17 illustrates a flowchart of an exemplary method 1700 for resistance exercise with a resistance exercise garment. Method 1700 may include an initial Step 1702 of aligning a pair of resilient pants with the legs, the pants being defined by a stretchable surface, an upper waist section, and a pair of legs terminating at two ankle ends, the ankle ends forming openings. In one embodiment, method 1700 may further comprise a Step 1704 of donning the pants, such that the feet pass through the openings. A Step 1706 includes fitting the feet into a pair of stirrup loop straps at the ankle ends.

In some embodiments, a Step 1708 comprises adjusting, with a hook and loop fastener strap, the ankle ends of the pants to form a snug fit around the ankles of the wearer. A Step 1710 includes removing a pair of elastic bands from a pair of fastenable pockets in the ankle ends, the elastic bands defined by a free second end and a first end fixedly attached to the pockets. In some embodiments, a Step 1712 may include grasping the second end of the elastic bands. A Step 1714 comprises pulling the elastic bands in a first direction, whereby an external resistance force is generated along the longitudinal of the elastic bands. Method 1700 may further comprise a Step 1716 of compacting the elastic bands into the fastenable pockets. A final Step 1718 of method includes fastening closed, with a hook and loop fastener, the fastenable pocket.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A resistance exercise garment, the garment comprising:

a pair of resilient pants operable to be worn by a wearer, the pants being defined by a stretchable surface, an upper waist section, and a pair of legs terminating at two ankle ends, the ankle ends forming openings;

a hook and loop fastener strap sewn at the ankle ends, the hook and loop fastener strap regulating the diameter of the ankle ends;

a pair of fastenable pockets being integral with the ankle ends of the pants, the fastenable pockets defined by an inner cavity;

a pair of elastic bands defined by a first end and a second end, the first end joined with the fastenable pockets, the elastic bands being compactable into the fastenable pockets, the elastic bands being operable to be pulled in a first direction towards the upper waist section, whereby the pulling the elastic bands in the first direction generates an external resistance force along the longitudinal of the elastic bands, whereby the fixed attachment between the fastenable pockets and the first end of the elastic bands helps counterbalance the external resistance force generated by pulling the elastic bands in the first direction; and a pair of stirrup loop straps at the ankle ends, the stirrup loop straps extending across the openings formed at the ankle ends.

2. The garment of claim 1, wherein the upper waist section is defined by a wide, foldable band.

3. The garment of claim 1, wherein the openings in the ankle ends enable passage of the ankles and the feet.

4. The garment of claim 3, wherein the stirrup loop straps receive the feet.

5. The garment of claim 4, wherein the feet prevent the ankle ends from moving in the first direction and help counterbalance the external resistance force generated by pulling the elastic bands in the first direction.

6. The garment of claim 5, wherein the hook and loop fastener strap regulates the snugness of the ankle ends around the ankles.

7. The garment of claim 1, wherein the ankle ends comprise a bottom hem, the bottom hem forming a tunnel.

8. The garment of claim 7, wherein the hook and loop fastener strap is sewn inside the tunnel that forms through the bottom hem.

9. The garment of claim 1, wherein the fastenable pockets are disposed longitudinally with the legs of the pants.

10. The garment of claim 1, further comprising a fastening mechanism operable with the fastenable pockets, the fastening mechanism regulating access to the inner cavity of the fastenable pockets.

11. The garment of claim 10, wherein the fastening mechanism closes the fastenable pockets when the elastic bands are inside the inner cavity.

12. The garment of claim 11, wherein the fastening mechanism includes at least one of the following: a zipper, a hook and loop fastener, a button, a magnet, a snap-fit connector, and an adhesive.

13. The garment of claim 1, wherein the first end of the elastic bands are fixedly attached to the pocket from inside the inner cavity.

14. The garment of claim 1, wherein the second end of the elastic bands terminate at a ring.

15. The garment of claim 1, wherein the elastic bands extend from the fastenable pocket to the upper waist section.

16. The garment of claim 1, wherein the pants, or the elastic bands, or both are double stitched.

17. The garment of claim 1, wherein the first end of elastic bands comprises a clip member detachably attachable to an anchor member that anchors inside inner cavity of pocket.

18. The garment of claim 1, further comprising a slide buckle operable to slide along the length of the elastic bands.

19. A resistance exercise garment, the garment comprising:

a pair of resilient athletic training pants operable to be worn by a wearer, the athletic training pants being defined by a stretchable surface, an upper waist section, and a pair of legs terminating at two ankle ends, the ankle ends forming openings, the openings in the ankle ends enabling passage of the ankles and the feet, the ankle ends comprising a bottom hem, the bottom hem forming a tunnel, the stretchable surface including at least one of the following materials: a Ponte Roma material, a blend of cotton, lycra spandex, nylon, polyester, wool, and a light and stretchy synthetic material;

a hook and loop fastener strap sewn at the ankle ends, the hook and loop fastener strap regulating the diameter of the ankle ends;

a pair of fastenable pockets being integral with the ankle ends of the pants, the fastenable pockets defined by an inner cavity, the fastenable pockets being disposed longitudinally with the legs of the pants;

a fastening mechanism operable with the fastenable pockets, the fastening mechanism regulating access to the inner cavity of the fastenable pockets; and a pair of elastic bands defined by a first end and a second end, the first end of elastic bands comprises a clip member detachably attachable to an anchor member that anchors inside inner cavity of pocket, the second end terminating at a ring, the elastic bands being compactable into the fastenable pockets, the elastic bands being operable to be pulled in a first direction towards the upper waist section, the elastic bands being double stitched, whereby the pulling the elastic bands in the first direction generates an external resistance force along the longitudinal of the elastic bands, whereby the fixed attachment between the fastenable pockets and the first end of the elastic bands helps counterbalance the external resistance force generated by pulling the elastic bands in the first direction;

a slide buckle operable to slide along the length of the elastic bands; and a pair of stirrup loop straps at the ankle ends, the stirrup loop straps extending across the openings formed at the ankle ends, the stirrup loop straps receiving the feet, whereby the feet prevent the ankle ends from moving in the first direction and help counterbalance the external resistance force generated by pulling the elastic bands in the first direction.

20. A method for resistance training with a resistance exercise garment, the method comprising:

aligning a pair of resilient pants with the legs, the pants being defined by a stretchable surface, an upper waist section, and a pair of legs terminating at two ankle ends, the ankle ends forming openings;

donning the pants, such that the feet pass through the openings;

fitting the feet into a pair of stirrup loop straps at the ankle ends;

adjusting, with a hook and loop fastener strap, the ankle ends of the pants to form a snug fit around the ankles of the wearer;

removing a pair of elastic bands from a pair of fastenable pockets in the ankle ends, the elastic bands defined by a free second end and a first end fixedly attached to the pockets;

grasping the second end of the elastic bands;

pulling the elastic bands in a first direction, whereby an external resistance force is generated along the longitudinal of the elastic bands;

compacting the elastic bands into the fastenable pockets; and fastening closed, with a hook and loop fastener, the fastenable pockets.

* * * * *